US009279643B2

(12) United States Patent
Herman

(10) Patent No.: US 9,279,643 B2
(45) Date of Patent: Mar. 8, 2016

(54) PREEMPTIVE COUNTERMEASURE MANAGEMENT

(75) Inventor: Carl R. Herman, Owego, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 646 days.

(21) Appl. No.: 13/493,571

(22) Filed: Jun. 11, 2012

(65) Prior Publication Data

US 2015/0268011 A1 Sep. 24, 2015

(51) Int. Cl.
*F41H 11/02* (2006.01)
*F41G 7/00* (2006.01)

(52) U.S. Cl.
CPC ..... *F41H 11/02* (2013.01); *F41G 7/007* (2013.01)

(58) Field of Classification Search
CPC ..... F41H 11/02
USPC ..... 89/1.11, 1.51
See application file for complete search history.

(56) References Cited

U.S. PATENT DOCUMENTS

| | | | | |
|---|---|---|---|---|
| 3,836,968 | A * | 9/1974 | Schillreff | 342/12 |
| 5,742,384 | A | 4/1998 | Farmer | |
| 6,369,885 | B1 | 4/2002 | Brown et al. | |
| 6,873,893 | B1 | 3/2005 | Sanghera et al. | |
| 7,138,938 | B1 * | 11/2006 | Prakah-Asante et al. | 342/70 |
| 7,210,392 | B2 * | 5/2007 | Greene et al. | 89/41.03 |
| 7,378,626 | B2 | 5/2008 | Fetterly | |
| 2003/0019350 | A1 * | 1/2003 | Khosla | 89/1.11 |
| 2006/0163446 | A1 | 7/2006 | Guyer et al. | |
| 2007/0206177 | A1 * | 9/2007 | Anschel et al. | 356/28 |

* cited by examiner

*Primary Examiner* — Reginald Tillman, Jr.
(74) *Attorney, Agent, or Firm* — Wolf, Greenfield & Sacks, P.C.

(57) ABSTRACT

Embodiments of the invention are directed to techniques for preemptively managing countermeasures of a vehicle. Prior to identifying an actual threat, at least one countermeasure device may be preemptively oriented to point in a direction most likely to produce a threat. The preemptive orientation may be determined my environmental information and/or vehicular information. Once an actual threat is identified, the countermeasure device may re-orient to point to the identified threat. The preemptive orientation may save time in the re-orientation process thereby providing extra time for countermeasures to be actively deployed.

20 Claims, 7 Drawing Sheets

Potential Threat Center of Mass Computation

500

$$(x_{COM}, y_{COM}) = \left( \sum_i W_i \cdot x_i, \sum_i W_i \cdot y_i \right)$$

$W_i$ = Threat weight for each potential threat location $x_i$ = x-coordinate of potential threat location $y_i$ = y-coordinate of potential threat location

FIG. 5

PREEMPTIVE COUNTERMEASURE MANAGEMENT

BACKGROUND OF INVENTION

Military vehicles are under constant threat of attack—especially aircraft. There are a variety of possible threat sources, for example enemy aircraft and ground-based weapons, such as shoulder launched missiles (SLMs). If successful, enemy attacks are devastating and almost certainly result in loss of the life of the aircraft's occupants. Accordingly, it is of utmost importance to immediately identify threats and deploy available countermeasures so as to prevent enemy attacks from being successful.

An aircraft's engine emits large amounts of heat, resulting in thermal infrared (IR) radiation. SLMs may use an IR seeker head missile to target the aircraft, allowing accurate targeting with little need for aiming accurately. An IR seeker head may lock on the heat signature of the aircraft and may distinguish the aircraft's heat signature from other heat signatures. Depending on the distance of the SLM source from the aircraft, the time from the SLM being fired until impact may be as short as 2-5 seconds. If the aircraft is to deploy countermeasures to prevent impact, it must do so immediately upon detecting the SLM.

SLMs risks are not limited to military aircraft. In the past, terrorist groups have targeted commercial aircraft. Accordingly, commercial aircraft may also avert disastrous SLM attacks by using countermeasure technology.

BRIEF SUMMARY OF INVENTION

Embodiments of the invention may be directed to a method of preemptively positioning at least one countermeasure device of a vehicle. The method may comprise computing a pre-threat orientation of the at least one countermeasure device based at least on environmental information about the current environment of the vehicle; and orienting the at least one countermeasure device based on the computed pre-threat orientation. Some embodiments may receive the environmental information. This may be accomplished by using at least one sensor of the vehicle to obtain measurements of the current environment; and determine the environmental information from the measurements. In some embodiments computing the pre-threat orientation may comprise computing a center of mass of a potential threat. The pre-threat orientation may further be based on vehicular information about the vehicle. The vehicular information may be, for example, a thermal map describing thermal emissions from the vehicle. In some embodiments, there may be a first countermeasure device and a second countermeasure device and the vehicular information comprises information about the operation of the first countermeasure device. One or more of the above acts of the method may be repeated.

Some embodiments are directed to a vehicle comprising at least one countermeasure device and at least one controller coupled to the countermeasure device, wherein the at least one controller is configured to perform one or more acts of the above method.

Some embodiments are directed to a least one computer readable medium encoded with instructions that, when executed on a computer system of a vehicle, perform one or more acts of the above method.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 5 illustrates an exemplary technique to determine the direction in which a countermeasure device should be preemptively oriented;

DETAILED DESCRIPTION OF INVENTION

The inventors have recognized and appreciated that reducing the amount of time needed to respond to a threat with countermeasures can save lives. The time that would normally be spent preparing to initiate a countermeasure response may instead be used actively implementing countermeasures, thereby greatly increasing the likelihood that the countermeasures will succeed.

A countermeasure device on a vehicle may have a default orientation. Typically, this default orientation is determined by internal wiring and/or vibrational considerations. At any given time, the countermeasure device may be powered up and ready to slew (i.e. orient so that it is pointed in a desired direction) to a desired orientation from its default orientation. The slew time it takes to slew from the default orientation to the desired orientation is wasted time in the overall implementation of countermeasures. The inventors have recognized and appreciated that, prior to identifying any particular threat, the countermeasure device may be actively orienting itself based on the current environment and/or the aircraft itself. By accounting for various characteristics of the environment and/or the aircraft, the countermeasure device may be oriented in the direction from which a potential threat may arrive. Accordingly, when a threat is identified, the countermeasure device may already be approximately oriented in the direction of the threat and more time may be spent actively countering the threat, rather than stewing to the desired orientation. Estimates show that by preemptively orienting the countermeasure device, slew time may be reduced on average by 90%.

In some embodiments, the countermeasure device may be a jammer used to confuse missiles with IR seeker capabilities. The jammer may track the incoming missile and direct an IR laser beam unto the IR seeker of the missile. The laser may emit various jam codes, not knowing which jam codes will be successful in deterring any particular missile. Accordingly, the jammer must cycle through many jam codes to find one that is successful. The more time the jammer has to transmit jam codes, the more likely it will be in successfully saving the aircraft and the people aboard the aircraft.

Figure 1:
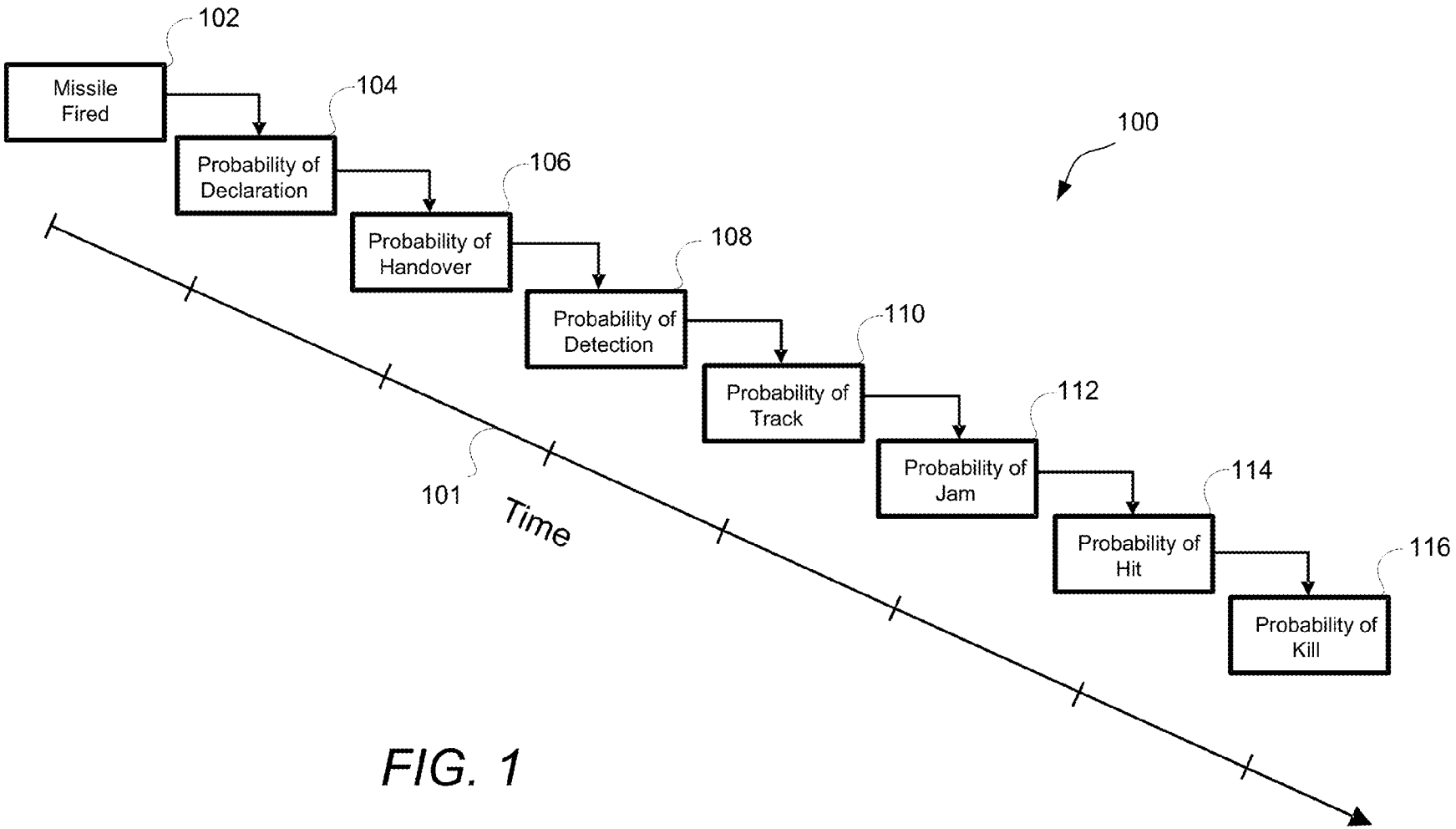
FIG. 1 is a simplified block diagram of an exemplary engagement model for some countermeasure techniques.

FIG. 1 illustrates a simplified block diagram of an exemplary engagement model 100 for some countermeasure techniques such as the aforementioned jammer. Line 101 represents the time from the time a missile is fired 102. The missile is located at a position in three-dimensional space. The first step in engaging the missile is to recognize the missile is airborne and identify the coordinates of the missile. The engagement model may include a probability of declaration 104 representing the probability that the aircraft's sensing system is successful in recognizing and identifying the position of the missile. The sensing system may be separate from the jamming system. Accordingly, the sensing system hands over the information it has obtained to the jamming system. There is some probability that the sensing system will fail to handover the missile coordinates and the model 100 represents this using the probability of handover 106. There is also a handover time associated with how long the handover takes to perform. The handover time may be on the order of milliseconds.

Upon receiving the missile coordinates from the sensing system, the jamming system itself must then detect the missile. There is some chance that the jamming system will not independently detect the missile given the coordinates from the sensing system. Accordingly, there is a probability of detection 108 associated with the model 100. There is also a timing element to detection. The detection time is the time it takes the jamming system to detect the missile given threat coordinates by the sensing system. It is this detection time that is decreased the most by preemptively orienting the jammer prior to a threat notification from the sensing system.

Once detected, the jamming system must track the missile, which is done with some probability known as the probability of track 112. The jamming system may use one or more sensor to take samples of the space and track the kinematic path of the missile. Tracking is be done in order to accurately aim the jamming laser emitted by the jammer.

The jamming system succeeds in jamming the missile with some probability known as the probability of jam 112. There is also a timing element associated with jamming, known as the jam time. The longer time the jammer spends actively attempting to jam the missile, the higher the probability of jam 112 will be. The jammer uses a laser to transmit a plurality of jam code sequences. The jam codes convey false information about the position of the aircraft by using IR signals related to the heat signature of the aircraft. The aircraft may, for example, initially send out ten different jam code sequences. The jamming system may then determine if any of the jam codes were successful. If the jamming section determines, for example, that the fourth jam code sequence was successful, it may need to accurately transmit the sequence some number of times for the jamming to be successful. This entire sequence of jamming events takes time (i.e. jam time). By increasing the jam time by even a third of a second, the jammer may cycle through dozens of alternative jam codes, significantly increasing the probability of jam 112. Embodiments of the invention are not limited to sending jam codes. For example, the jammer may attempt to blind the IR sensor of the missile head by saturating the sensor with a laser beam. This type of counter measure may also be increasingly successful given more time spent actively blinding the missile's IR sensor. Countermeasure devices other than jammers may also benefit from preemptive countermeasure techniques described herein.

Model 100 may also include a probability of hit 114 and probability of kill 116. Probability of hit 114 relates to the likelihood that the missile will actually hit the aircraft. Probability of kill 116 relates to the likelihood that, if the missile hits the aircraft, that the occupants will be killed.

Embodiments are not limited to any particular engagement model 100 or type of countermeasure. FIG. 1 illustrates one possible technique for modeling an aircraft's engagement with a missile. Any suitable model may be used.

Figure 2:
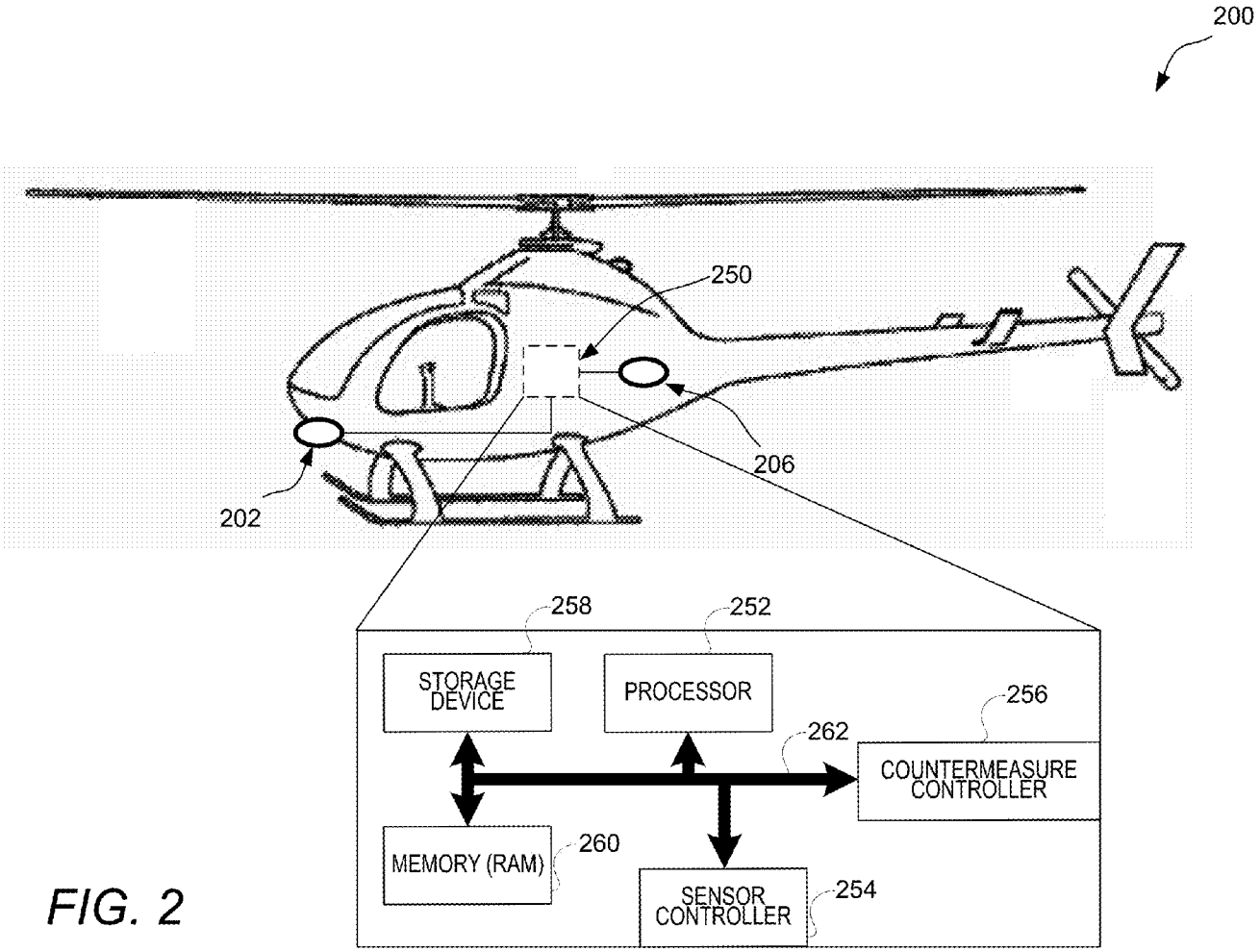
FIG. 2 is an exemplary vehicle that may implement countermeasure techniques of some embodiments.

FIG. 2 is an exemplary vehicle 200 that may implement countermeasure techniques of some embodiments. Vehicle 200 may be any suitable vehicle. For example, it may be an aerial vehicle, such as a helicopter, jet, blimp or airplane. Some embodiments may use a car, truck, tank, or any land-based vehicle. Alternatively, vehicle 200 may be aquatic vehicles, such as boats and ships, or space vehicles, such as space shuttles, space stations or satellites. Vehicle 200 need not be a manned vehicle. The vehicle may be unmanned and/or autonomous. In some embodiments, the vehicle may be controlled by remote control.

Vehicle 200 may comprise at least one sensor 202 to acquire information about the vehicle's surrounding environment. Any suitable sensor 202 may be used. For example, the sensor may be a digital camera, radar, or LIDAR. Sensor 202 may collect information about the environment and provide this information to a computer system 250 for processing. The location and number of sensors 202 is not limited in any way Vehicle 200 may comprise at least one countermeasure device 206 for implementing countermeasure techniques. Any suitable countermeasure device 206 may be used. For example, an IR jammer for transmitting jam codes may be used. In some embodiments, a laser may be used to blind IR seeking missile heads. Countermeasure device 206 may be a flare emitter configured to emit flares used to confuse IR seeking weapons by introducing additional heat sources into the environment to confuse the tracking device of the weapon. However, countermeasure devices are not limited to limited to countermeasures against IR seeking missiles. Chaff is a countermeasure technique wherein small pieces of a material, such as metal or plastic, is spread in an attempt to confuse enemy radar systems. Accordingly, countermeasure device 206 may be a chaff emitter. Alternative countermeasure devices may include a visual acquisition disruption (VAD) device which transmits a laser beam to blind an enemy's eye to cause temporary blindness. In some embodiments, offensive weapons such as guns may be considered countermeasure devices.

The location and number of countermeasure devices 206 is not limited in anyway. FIG. 2 illustrates sensor 202 and countermeasure device 206 as separate devices. However, embodiments of the invention are not so limited. For example, countermeasure device 206 may comprise at least one sensor for detecting and tracking a threat or potential threat, such as a missile. There may be additional sensors 202 that are part of a sensing system as well as sensors 202 that are part of the countermeasure system. In some embodiments, the sensing system and the countermeasure system may be one and the same system. FIG. 2 illustrates countermeasure device 206 on the side of vehicle 200 visible in the drawing. However, embodiments are not limited to this placement. One or more countermeasure device 206 may be on top of or on the bottom of vehicle 200. There may also be more at least one countermeasure device 206 on the opposite side of the vehicle, not shown in FIG. 2.

Both sensor 202 and countermeasure device 206 are coupled to computing system 250. Signals carrying data obtained by sensor 202 are transmitted to computing system 250 and control signals generated by computing system 250 may be transmitted to sensor 202. Similarly, signals carrying information to control countermeasure device 206 may be transmitted from the computing system 250 to the countermeasure device 206 and countermeasure device 206 may provide information or feedback to computing system 250.

Computing system 250 may be any suitable computing device which may, but is not limited to, include components such as a processor 252, memory 260, a storage device 258, sensor controller 254 and countermeasure controller 256. The components of computing system 250 may communicate using system bus 262. The system bus 262 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computing device 250 may comprise a variety of computer readable media. Computer readable media can be any available media that can be accessed by computing system 250 and includes both volatile and nonvolatile media, removable and non-removable media. By way of example, and not limitation, computer readable media may comprise non-transitory computer storage media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computing device 250. Combinations of any of the above should also be included within the scope of computer readable media.

The memory 260 may include computer storage media in the form of volatile and/or nonvolatile memory such as read only memory (ROM) and random access memory (RAM). Memory 260 may contain data and/or program modules that are immediately accessible to and/or presently being operated on by processor 252. By way of example, and not limitation, this data may be an operating system, application programs, other program modules, and program data.

Computing device 250 may also include other removable/non-removable, volatile/nonvolatile computer storage media. By way of example only, FIG. 2 illustrates a storage device 258 which may comprise a hard disk drive or an optical disk drive that reads from or writes to a removable, nonvolatile optical disk such as a CD ROM or other optical media. Other removable/non-removable, volatile/nonvolatile computer storage media that can be used in the exemplary operating environment include, but are not limited to, flash memory cards, digital versatile disks, digital video tape, solid state RAM, solid state ROM, and the like.

A processor 252 may be a central processing unit (CPU) or a specialized processor, such as an application specific integrated circuit (ASIC) or a field programmable gate array (FPGA). Sensor controller 254 and countermeasure controller 256 are shown separate from processor 252 in FIG. 2, but in some embodiments the controllers may be implemented by a computer program operating on processor 252. In some embodiments sensor controller 254 and countermeasure controller 256 may be implemented as hardware, software or both hardware and software. Embodiments are not limited to any particular type of controller. Sensor controller 254 receives and transmits signals to the at least one sensor 202 and countermeasure controller 256 receives and transmits signals to the at least one countermeasure device 206.

Figure 3:
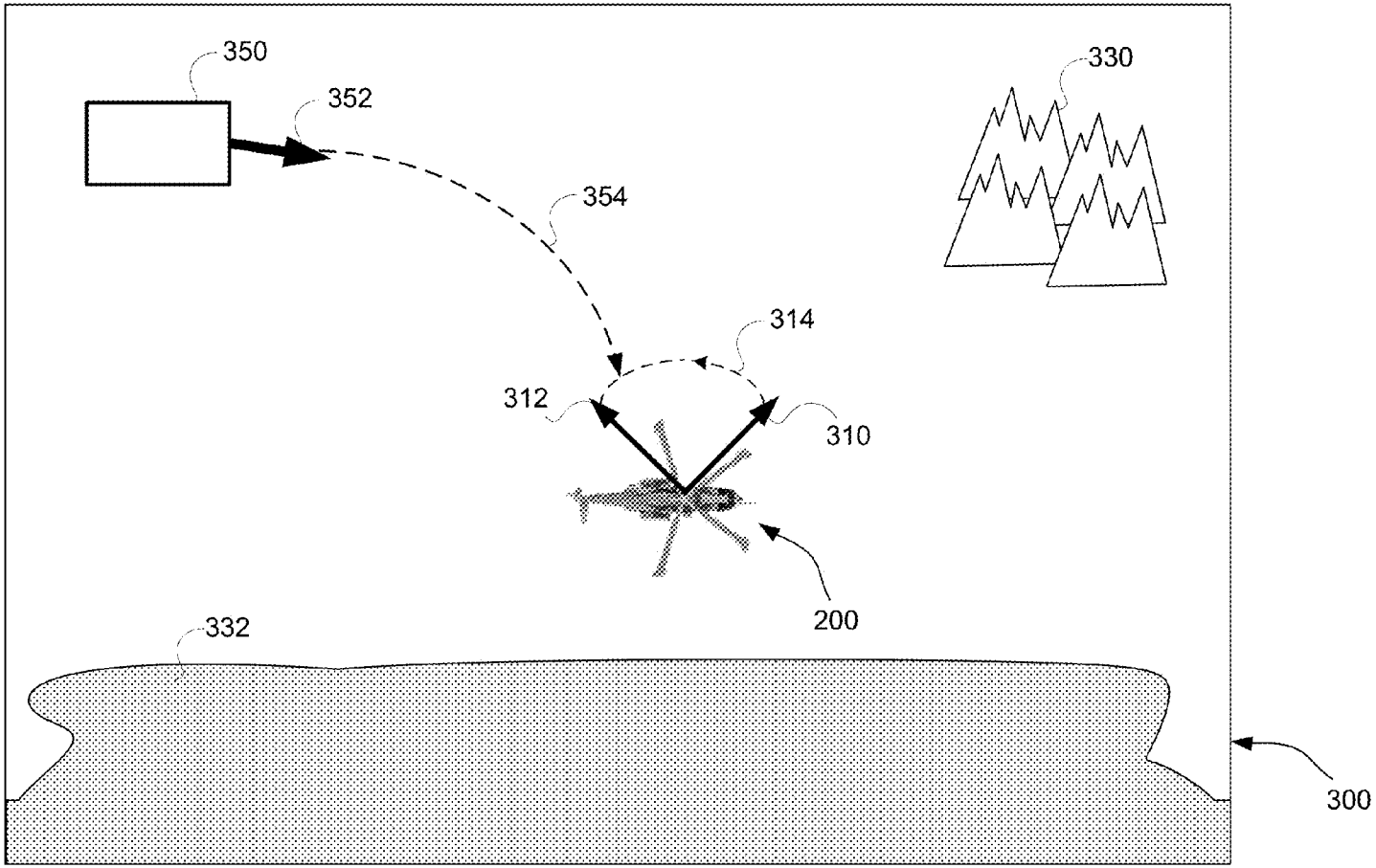
FIG. 3 is a simplified diagram of an environment in which countermeasures may be deployed.

FIG. 3 is a simplified diagram of an environment 300 in which countermeasures may be deployed and is helpful in describing the problem addressed by embodiments of the invention. Environment 300 comprises the area surrounding vehicle 200. The current environment of vehicle 200 changes as the vehicle travels. Various aspects of the environment 300 may be used by the countermeasure system of vehicle 200. For example, FIG. 3 illustrates a current environment 300 that comprises a body of water 332 and mountainous region 330. The environment 300 also comprises an enemy with a SLM launching device 350. The enemy is likely too small for vehicle 200 to recognize as a threat and the threat may only be detected once SLM launching device 350 fires missile 353 (represented by an arrow).

Vehicle 200 may have a countermeasure device 206 which is oriented at a default position 310 (represented by an arrow) such that it always points in the same direction prior to identifying a threat. In this situation, when vehicle 200 detects missile 352 following trajectory 354 towards vehicle 200, there may be only a matter of seconds to implement countermeasures and avoid impact. Before countermeasure techniques may even begin to be implemented, countermeasure device 206 must move from its default position 310 to the desired position 312, traversing angle 314. This re-orientation of the countermeasure device 206 may be referred to as stewing and the time it takes for the countermeasure device 206 to slew may be referred to as the slew time. The slew time is a significant amount of time in the overall countermeasure process because it may involve many mechanical motions, such as re-orienting one or more mirrors used to direct a laser beam to a particular location. Embodiments of the present invention are directed to reducing this slew time by preemptively orienting the countermeasure device 206 to be pointed in the direction from which a threat is most likely to come.

For example, in the current environment 300 illustrated in FIG. 3, embodiments of the invention may use information about the environment to determine the orientation of countermeasure device 206. For example, the countermeasure system may attribute little to no risk to body of water 332 because an attack may be unlikely to come from water. Similarly, if mountains 330 are sufficiently treacherous, it may be unlikely that an attack would come from that direction. Accordingly, vehicle 200 would benefit by preemptively orienting countermeasure device 206 in the direction represented by arrow 312. Even if vehicle 200 is unaware of enemy missile launcher 350, the area from the top of environment 300 to the left of environment 300 is the area where an attack is most likely to originate. Accordingly, countermeasure device 206 may be oriented to the middle of that large area thereby preventing the need to slew countermeasure device 206 to begin actively implementing countermeasures.

Vehicle 200 may also take into account information about itself when determining which direction to preemptively orient countermeasure device 206. For example, every vehicle may have an associated three-dimensional thermal map detailing which areas of vehicle 200 get hot during operation. Areas of the vehicle 200 near the engines and exhaust may get hotter than areas near the nose of the a vehicle 200. Accordingly, because IR seeking missiles target parts of the vehicle that radiate heat, it is more likely that a missile will approach the vehicle from a direction with a line of sight to the hot regions of the vehicle 200. For example, if vehicle 200 is a jet, a large amount of heat is radiated from the rear of the jet. Accordingly, the countermeasure system may preemptively orient the countermeasure device 206 to the rear of the vehicle 200.

Embodiments of the invention are not limited to using any particular type of environmental information or vehicular information. For example, vehicular information may comprise real-time information about the vehicle. If vehicle 200 comprises more than one countermeasure device 206 and one of the countermeasure devices is malfunctioning, the countermeasure system may take this information into account when orienting the active countermeasure device 206. Likewise, if all countermeasure devices are operational, the countermeasure system may take this into account when preemptively orienting each of the countermeasure devices. Vehicular information may also comprise status information about any other component or system of vehicle 200. In some embodiments, vehicular information may comprise position and orientation information of vehicle 200 itself. For example, pitch, roll and yaw information may be taken into account my the countermeasure system.

In some embodiments, only environmental information may be used by the countermeasure system, wherein in other embodiments only vehicular information may be used. Vehicle 200 may also use both environmental information and vehicular information when preemptively orienting the countermeasure device 206.

Figure 4A:
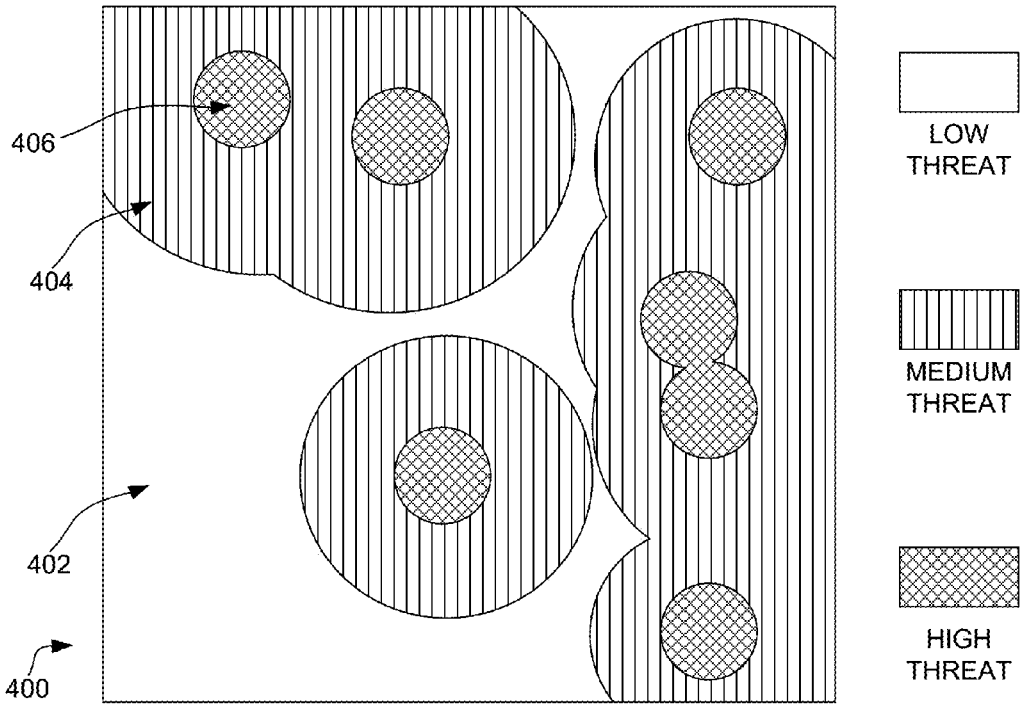
FIG. 4A illustrates an exemplary threat map used in some embodiments.

The environmental information may take any suitable form. For example, FIG. 4A illustrates an exemplary threat map 400 used in some embodiments as environmental information. The threat map 400 applies different levels of potential threat to each point in space. By way of example, and not limitation, FIG. 4A illustrates three levels of potential threat: low threat, medium threat and high threat. Embodiments of the invention are not limited to any particular number of threat levels. Vehicle 200 may take into account the different threat levels of each location when determining the preemptive orientation of countermeasure device 206. For example, the countermeasure device 206 may be least likely to be pointed in the direction of low threat area 402, more likely to point in the direction of medium threat area 404 and most likely to point in the direction of high threat area 406. These threat levels do not represent verified or identified threats. Instead, they rank the likelihood that a threat will originate from any particular location.

Figure 4B:
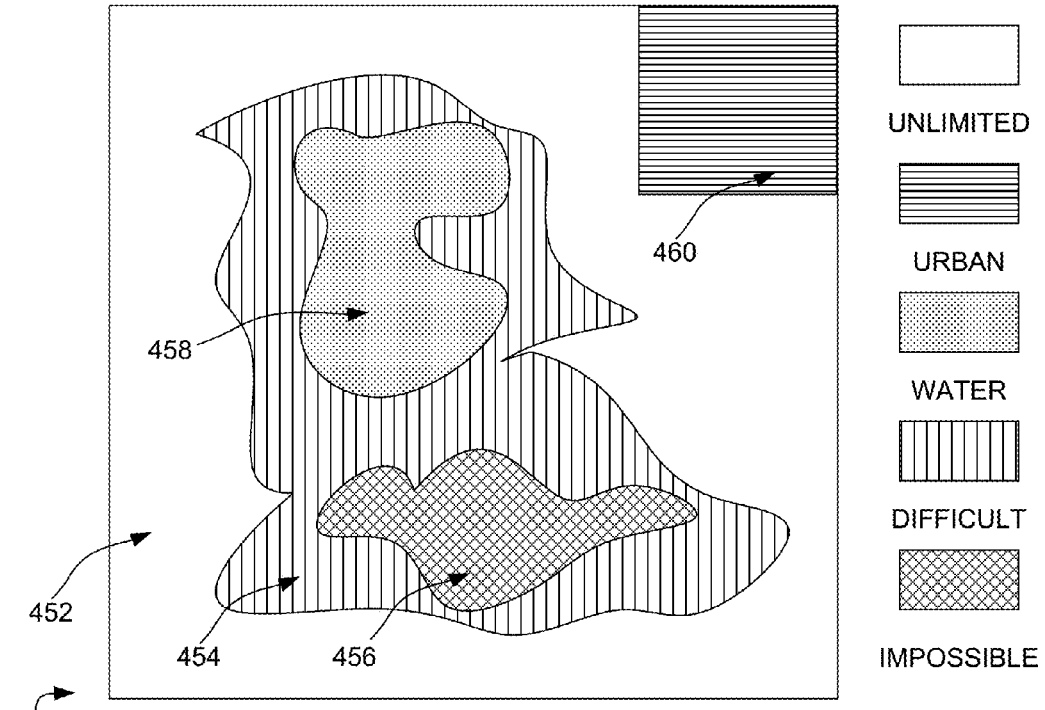
FIG. 4B illustrates an exemplary geographic mobility cost map used in some embodiments.

FIG. 4B illustrates an exemplary geographic mobility cost map 450 used as environmental information in some embodiments. Geographic mobility cost maps 450 are typically used for planning a travel route for land vehicles. The maps 450 may indicate the "transportability" of different areas, which describes how easy or difficult it is to travel in said area. For example, a sheer cliff area may be impossible to travel through, whereas a hilly area may be relatively easy to travel through. Geographic mobility cost map 450 illustrates several regions: areas of unlimited travel 452, areas where it is difficult to travel 454, areas where it is impossible to travel 456, areas of water 458 and urban areas 460. The areas illustrated in FIG. 4B are by way of example, not limitation. Geographic mobility cost maps 450 are not limited to any particular number or type of area.

In some embodiments, vehicle 200 may preemptively orient the countermeasure device 206 based on the transportability of areas in the current environment. For example, it may not be desirable to orient countermeasure device 206 towards an area 456 that is impossible to navigate because it would be unlikely that a threat would originate from that area.

The environmental information, which could be, for example, threat map 400 or geographic mobility cost map 450, may be obtained in any suitable way. For example, the environmental information may be loaded into storage device 258 of vehicle 200 at some previous time, such as while the vehicle is at some base station. In some embodiments, vehicle 200 may receive the environmental information while in transit via at least one information receiver, such as a satellite link, a radio frequency signal or any other suitable communication device.

Embodiments of the invention may use the environmental information to preemptively orient countermeasure device 206 in any suitable way. For example, vehicle 200 may determine the location in the current environment that has the highest risk and preemptively orient countermeasure device 206 to point to that area. However, in situations where there are multiple high potential threat level areas, as illustrate by threat map 400 of FIG. 4A, vehicle 200 must determine in which direction to orient countermeasure device 206. In some embodiments, countermeasure device 206 may be oriented such that it points in the direction of the high threat level area closest to vehicle 200. If a missile were fired from any of the high threat areas, a missile fired from the closest location would have the shortest flight time before impact. Accordingly, the closest potential high threat location would benefit the most from additional jam time. In some embodiments, if there are multiple potential high threat locations, the countermeasure system may prioritize the location that with the clearest line of sight to the portion of vehicle 200 that emits the most thermal radiation. This may be determined using, for example, a thermal map of the vehicle 200.

Some embodiments may weight each location and determine an orientation of countermeasure device 206 that points to the average location that a threat would come from. For example, if there were two high potential threat locations equidistant from vehicle 200, the countermeasure device 206 may be oriented such that it points at a location in the middle of the two locations. Accordingly, if a missile is fired from either location, it is not precisely aimed at the missile from the time the missile is fired, but it will be a short slew time to re-orient countermeasure device 206 to be directed at the location where the missile originated.

FIG. 5 illustrates an exemplary technique to determine the direction in which a countermeasure device should be preemptively oriented. Equation 500 illustrates a "center of mass" calculation. A weight ($W_i$) is assigned to every location, each location being denoted by the letter "i." The weight may be determined from threat map 400, geographic mobility cost map 450, or any other source of environmental information. Each location, "i" has a location determined by x-coordinate, $x_i$, and y-coordinate, $y_i$. The center of mass location coordinates, ($x_{com}$, $y_{com}$) are determined by performing a weighted sum of each individual location, as illustrated by equation 500. Any number of weights and locations may be used. For example, every location may be used in equation 500 and if a particular location has zero risk, then assigning a weight of zero to that location will effectively remove that location from the calculation. In some embodiments, only a subset of locations may be used in equation 500, such as locations that have a potential threat greater than a certain threshold. For example, if each location was given a potential risk weight from zero to ten, only locations with weights greater than or equal to five may be used. This would have the effect of masking out the locations that are lower risk and focusing on the higher risk locations in determining the orientation of countermeasure device 206.

Equation 500 of FIG. 5 is an equation that, by way of example, not limitation, may be used to determine in what direction to preemptively point countermeasure device 206. Any suitable equation or technique may be used. Embodiments are not limited in this manner.

Figure 6:
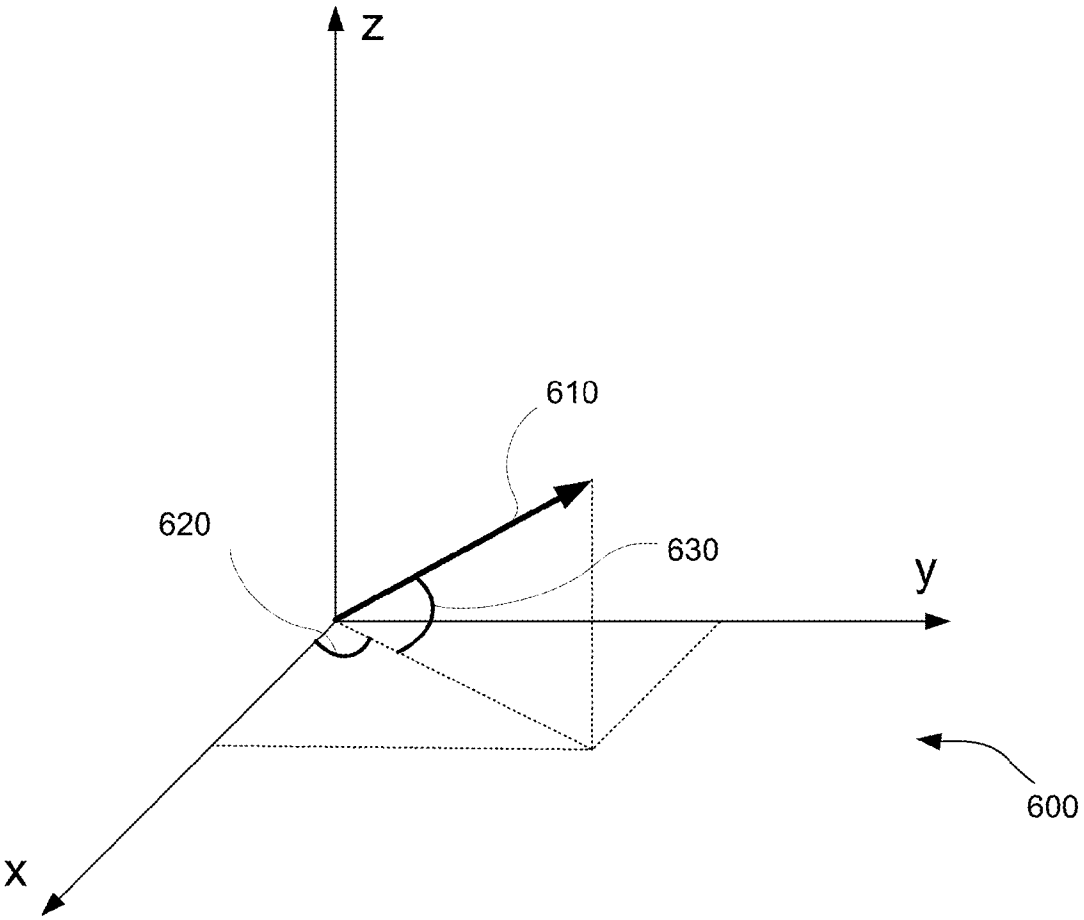
FIG. 6 is a simplified diagram illustrating an azimuthal angle and an elevation angle associated with the orientation of a countermeasure device.

Orienting the countermeasure device 206 may be done in any suitable way. FIG. 6 illustrates an exemplary embodiment where the orientation of the countermeasure device 206 uses an azimuthal angle 620 and an elevation angle 630 of the countermeasure device 206 (represented by arrow 610 of FIG. 6). From the point of view of vehicle 200, every location on the ground has a two-dimensional position, which may be represented as an x-coordinate and a y-coordinate. The coordinates of each location must be translated into a coordinate system useful for countermeasure device 206. Some embodiments will use an azimuthal angle 620 and an elevation angle 630, where the two-dimensional coordinates of each location on the ground maps to the two angles. In some embodiments, when translating the coordinates of a threat to the azimuthal angle 620 and the elevation angle 630, the countermeasure system may take into account the current pitch, roll and yaw of the vehicle 200. In some embodiments, rather than finding the center of mass using the x and y coordinates of each potential threat location as described in FIG. 5, the azimuthal angle and elevation angle of every potential threat may be used to compute a center of mass pair of angles.

Figure 7:
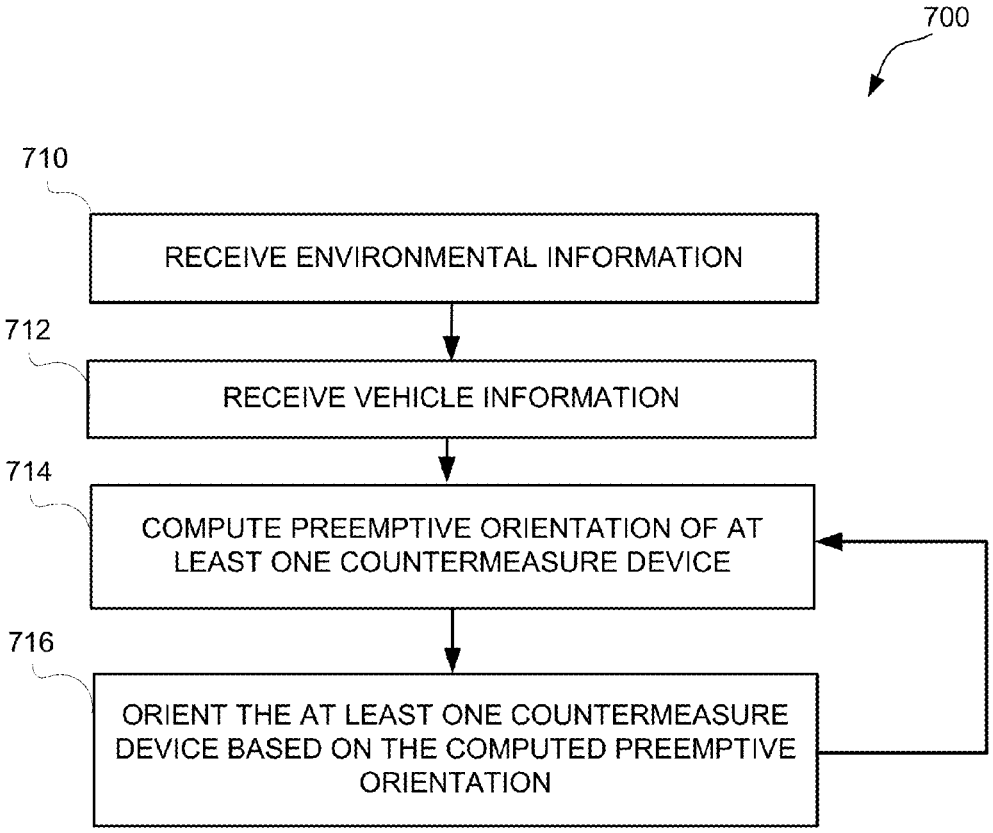
FIG. 7 illustrates a schematic flow diagram of an exemplary embodiment for preemptively positioning at least one countermeasure device.

FIG. 7 illustrates a schematic flow diagram of an exemplary method 700 for preemptively positioning at least one countermeasure device. Method 700 may be performed by countermeasure controller 256, processor 252 or any suitable combination of hardware and software of vehicle 200. Embodiments are not limited to include each act of method 700, nor are embodiments limited to only performing the acts illustrated in method 700.

At act 710, environmental information is received. Any suitable environmental information may be received. The environmental information may be a threat map, a geographic mobility cost map, or any other information about the current environment of vehicle 200. Embodiments are not limited to receiving the environmental information in any particular way. For example, the environmental information may be pre-loaded on storage device 258 before vehicle 200 is in transit. In other embodiments, the environmental information may be received while vehicle 200 is in transit. For example, vehicle 200 may receive environmental information via wireless transmission from a source, such as a base station, a satellite, or another vehicle. Alternatively, vehicle 200 may use sensor 202 to acquire the environmental information in real-time by sensing and recording data about the current environment.

At act 712, vehicular information may be received. Any suitable vehicular information may be used. For example, vehicular information may be a thermal map indicating portions of vehicle 200 that emit the most thermal radiation. The vehicular information may also include real-time information about the status of the at least one countermeasure device 206. For example, if there are two countermeasure devices and one of them is malfunctioning, this information may be used in determining how to orient the remaining countermeasure device. Vehicular information may also comprises the orientation and/or the position of the vehicle. For example, current pitch, roll, and yaw information may be used, as well as the vehicle's current coordinates in space. Embodiments are not limited to receiving the vehicular information in any particular way. For example, the vehicular information, such as a thermal map, may be pre-loaded on storage device 258 before vehicle 200 is in transit. In other embodiments, the vehicular information may be determined while vehicle 200 is in transit. For example, real time status information pertaining to available countermeasure devices may be received by processor 252 and/or countermeasure controller 256. Status information is not limited to information pertaining to countermeasure devices. For example, vehicular information may also comprise status information about various sensors, or any other aspect of the vehicle.

At act 714, the preemptive orientation of at least one counter measure device 206 is computed. This may be done in any suitable way. For example, the calculation may be done using processor 252 and/or countermeasure controller 256. Any suitable algorithm may be used. Preemptive orientation calculations may be based on environmental information and/or vehicular information. For example, if a threat map is used, the "center of mass" of all potential threats may be computed. In other embodiments, only high threat locations may be taken into account in the calculation. Vehicular information, such as a thermal map and/or pitch, roll and yaw information may also be taken into account when calculation the orientation of the at least one countermeasure device 206.

At act 716, the at least one countermeasure device 206 is oriented based on the result of the preemptive orientation computation. This may be done in any suitable manner and may depend on the type of countermeasure device 206 being used. For example, orienting an IR jammer utilizing an IR laser may comprise moving one or more mirrors and/or one or more lenses in an optical system of the countermeasure device. Alternatively, an emitter of countermeasure device 206 may be mechanically stewed to point in the computed direction.

All or portions of method 700 may be repeated. For example, acts of method 700 may be repeated periodically in time. Alternatively, acts may be repeated after vehicle 200 has traveled some distance. Some or all of the acts of method 700 may be repeated. Embodiments are not limited to repeating any particular acts. For example, FIG. 7 illustrates repeating the computing act 714 and the orienting act 716. This may be an embodiment where the environmental and vehicular information was pre-loaded on storage device 258 and it is not necessary to repeat the acquisition of this data. In embodiments where environmental and/or vehicular information is gathered in real-time by one or more sensors of vehicle 200, the method may repeat both receiving acts 710 and 712. Embodiments are not limited to any particular repetition.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein. Accordingly, the foregoing description and drawings are by way of example only.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Use of the term "and/or" in the claims and the specification is intended to indicate that one or both of the cases it connects may occur. For example, "A and/or B will occur" means "A will occur, B will occur, or A and B will occur."

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A method of preemptively positioning at least one countermeasure device of a vehicle, comprising:

(a) computing, using at least one controller, a pre-threat orientation of the at least one countermeasure device based at least on environmental information about the current environment of the vehicle; and (b) orienting the at least one countermeasure device based on the computed pre-threat orientation.

2. The method of claim 1, wherein:

computing the pre-threat orientation of the at least one countermeasure device occurs prior to identifying a threat; and the method further comprises repeating acts (a) and (b).

3. The method of claim 1, further comprising:

receiving the environmental information about the current environment of the vehicle, wherein receiving the environmental information comprises:

using at least one sensor of the vehicle to obtain measurements of the current environment; and determining the environmental information from the measurements.

4. The method of claim 1, wherein computing the pre-threat orientation comprises computing a center of mass of a potential threat.

5. The method of claim 1, wherein computing the pre-threat orientation is further based on vehicular information about the vehicle.

6. The method of claim 5, wherein the vehicular information comprises a thermal map describing thermal emissions from the vehicle.

7. The method of claim 5, wherein:

the at least one countermeasure device comprises a first countermeasure device and a second countermeasure device; and the vehicular information comprises information about the operation of the first countermeasure device.

8. A vehicle comprising:

at least one countermeasure device;

at least one controller coupled to the countermeasure device, wherein the at least one controller is configured to:

(a) compute a pre-threat orientation of the at least one countermeasure device based at least on environmental information about the current environment of the vehicle; and (b) orient the at least one countermeasure device based on the computed pre-threat orientation.

9. The vehicle of claim 8, wherein the controller is further configured to:

repeat acts (a) and (b).

10. The vehicle of claim 8, wherein the controller is further configured to:

receive the environmental information about the current environment of the vehicle, wherein receiving the environmental information comprises:

using at least one sensor of the vehicle to obtain measurements of the current environment; and determining the environmental information from the measurements.

11. The vehicle of claim 8, wherein computing the pre-threat orientation comprises computing a center of mass of a potential threat.

12. The vehicle of claim 8, wherein computing the pre-threat orientation is further based on vehicular information about the vehicle.

13. The vehicle of claim 12, wherein the vehicular information comprises a thermal map describing thermal emissions from the vehicle.

14. The vehicle of claim 12, wherein:

the at least one countermeasure device comprises a first countermeasure device and a second countermeasure device; and the vehicular information comprises information about the operation of the first countermeasure device.

15. At least one computer readable medium encoded with instructions that, when executed on a computer system of a vehicle, perform a method of preemptively positioning countermeasures, the method comprising:

(a) computing a pre-threat orientation of the at least one countermeasure device based at least on environmental information about the current environment of the vehicle; and (b) orienting the at least one countermeasure device based on the computed pre-threat orientation.

16. The at least one computer readable medium of claim 15, wherein computing the pre-threat orientation comprises computing a center of mass of a potential threat.

17. The at least one computer readable medium of claim 15, wherein computing the pre-threat orientation is further based on vehicular information about the vehicle.

18. The at least one computer readable medium of claim 17, wherein the vehicular information comprises a thermal map describing thermal emissions from the vehicle.

19. The at least one computer readable medium of claim 17, wherein:

the at least one countermeasure device comprises a first countermeasure device and a second countermeasure device; and the vehicular information comprises information about the operation of the first countermeasure device.

20. The vehicle of claim 8, wherein the at least one countermeasure device is a jam head.

* * * * *

UNITED STATES PATENT AND TRADEMARK OFFICE

CERTIFICATE OF CORRECTION

PATENT NO. : 9,279,643 B2
APPLICATION NO. : 13/493571
DATED : March 8, 2016
INVENTOR(S) : Carl R. Herman It is certified that error appears in the above-identified patent and that said Letters Patent is hereby corrected as shown below:

Title Page,

Item 57 in the Abstract, at line 6, delete “my” and replace it with --by--.

In the Specification,

In column 7, line 17, please replace “my” with --by--.

Signed and Sealed this
Thirty-first Day of May, 2016

Michelle K. Lee

Michelle K. Lee
*Director of the United States Patent and Trademark Office*